US010263317B2

(12) United States Patent
Bietz

(10) Patent No.: US 10,263,317 B2
(45) Date of Patent: Apr. 16, 2019

(54) UTILITY METER WITH INSULATED EXTERNAL ANTENNA

(71) Applicant: General Electric Company, Schenectady, NY (US)

(72) Inventor: Steven Bietz, Atlanta, GA (US)

(73) Assignee: General Electric Company, Schenectady, NY (US)

( * ) Notice: Subject to any disclaimer, the term of this patent is extended or adjusted under 35 U.S.C. 154(b) by 142 days.

(21) Appl. No.: 15/123,782

(22) PCT Filed: Mar. 9, 2015

(86) PCT No.: PCT/US2015/019542
§ 371 (c)(1),
(2) Date: Sep. 6, 2016

(87) PCT Pub. No.: WO2015/135000
PCT Pub. Date: Sep. 11, 2015

(65) Prior Publication Data

US 2017/0018837 A1 Jan. 19, 2017

Related U.S. Application Data

(60) Provisional application No. 61/949,943, filed on Mar. 7, 2014.

(51) Int. Cl.
*H01Q 1/04* (2006.01)
*H01Q 1/22* (2006.01)
(Continued)

(52) U.S. Cl.
CPC ..... *H01Q 1/2233* (2013.01); *H01Q 1/42* (2013.01); *H01Q 1/50* (2013.01)

(58) Field of Classification Search
CPC ..... H01Q 1/2233; H01Q 1/22; H01Q 1/42; H01Q 1/50
See application file for complete search history.

(56) References Cited

U.S. PATENT DOCUMENTS 4,491,792 A 1/1985 Bullock et al.
6,072,405 A * 6/2000 Sears ..... G01F 15/063 340/870.02

(Continued)

FOREIGN PATENT DOCUMENTS

CN 2662255 Y 12/2004

OTHER PUBLICATIONS

Extended European Search Report and Opinion issued in connection with corresponding EP Application No. 15759211.4 dated Oct. 24, 2017.

(Continued)

*Primary Examiner* — Tho G Phan
(74) *Attorney, Agent, or Firm* — Parks IP Law LLC

(57) ABSTRACT

The present technology discloses a utility meter with an externally-mounted antenna that is electrically insulated to prevent conduction outside of the meter. The antenna is coupled to a communication device that is positioned adjacent to an inside surface of a meter cover and that is configured to connect to a metrology board. The utility meter also comprises an antenna, having one or more leads for coupling with the communication device, the leads extending through openings in the meter cover. The communication device is advantageously positioned to minimize or eliminate radio frequency interference with the metrology board.

21 Claims, 9 Drawing Sheets

(51) Int. Cl.
*H01Q 1/42* (2006.01)
*H01Q 1/50* (2006.01)

(56) References Cited

U.S. PATENT DOCUMENTS

| | | | | |
|---|---|---|---|---|
| 6,300,907 | B1 | 10/2001 | Lazar et al. | |
| 8,228,209 | B2 * | 7/2012 | Smith | G01D 4/002 340/870.02 |
| 9,093,744 | B2 * | 7/2015 | Seal | H01Q 9/16 |
| 9,525,202 | B2 * | 12/2016 | Podduturi | H01Q 1/2233 |
| 9,939,474 | B2 * | 4/2018 | Sato | G01R 22/063 |
| 2002/0089428 | A1 | 7/2002 | Walden et al. | |
| 2006/0284784 | A1 | 12/2006 | Smith et al. | |
| 2010/0253538 | A1 * | 10/2010 | Smith | G01D 4/002 340/870.02 |
| 2011/0063172 | A1 | 3/2011 | Podduturi | |
| 2012/0098710 | A1 | 4/2012 | Seal et al. | |
| 2014/0022134 | A1 | 1/2014 | Owens | |
| 2016/0093947 | A1 * | 3/2016 | Kenig | H01Q 1/36 343/878 |

OTHER PUBLICATIONS

International Search Report in corresponding application No. PCT/US2015/019542 dated Jun. 17, 2015.

* cited by examiner

UTILITY METER WITH INSULATED EXTERNAL ANTENNA

RELATED APPLICATION

This application claims priority to U.S. Provisional patent application 61/949,943, filed Mar. 7, 2014, which is incorporated herein by reference.

FIELD OF INVENTION

The present technology relates to utility meters, and more specifically, to utility meters with externally-mounted RF antennas.

BACKGROUND OF THE INVENTION

Utility meters incorporate many functionalities relating to the consumption of a utility such as water, electricity, and gas, among others. Utility meters may enable a utility provider to remotely monitor utility usage by a customer or group of customers.

Antennas provide a way to connect utility meter components (e.g., network interface controller (NICs)) to a network. Antennas allow transmission of data obtained from a metering circuit through the NIC to the network for remote accessibility, such as to allow remote meter reading or provisioning of new utility services to customers. Remote accessibility can minimize issues associated with human meter reading, such as the cost of human capital to read meters, as well as the resulting mistakes.

Data received from the metering circuit can be transmitted to the network via a wireless data transfer medium (e.g., radio, ultrasonic, or infrared systems), or via a telephone or computer network, optical link or other wired communications medium (e.g., power line carrier).

Mounting an antenna internal to a utility meter (e.g., under a utility meter cover) has been used as a solution to connect the utility meter to a network. However, when the antenna is mounted under the cover of the utility meter, radio frequency (RF) interference with electronics and conductors may pose an issue with data transmission from the antenna to the network.

To reduce RF interference, the antenna can be mounted outside of the utility meter cover. Such external mounting solutions typically involve mounting the antenna to the meter box and passing a cable through a back of a meter base. Care must be taken to isolate the external antenna, for example, by providing an alternate power supply for the NIC, or by connecting the antenna to the NIC via an RF coupler. Failure to do so can create the risk of electric shock, which is of particular concern in residential installations. Such configurations can be cost prohibitive, particularly when applied to a large-scale utility operation.

SUMMARY OF THE INVENTION

Due to the aforementioned deficiencies, it is desirable to have utility meter with an externally mounted antenna that is safe and effective.

It is a goal of the present technology to realize the improved radio frequency (RF) performance in communications associated with a utility meter, while preventing undesirable conduction of electricity outside of the meter. In the present technology, RF performance is improved by positioning an antenna outside a cover that protects the meter and at least partially encloses the meter housing. The approach to external mounting achieves the desired reduction of interference posed by proximity to electronics and conductors within the utility meter and improves efficiency of data transmission to the network via the NIC. The safety aspect of the goal is achieved by enclosing the antenna within an antenna housing, and in some embodiments, further by embedding the antenna within the surface of meter cover or positioning the antenna within a recess formed in the meter cover.

The present technology discloses a utility meter that includes a communication device that can be positioned approximately adjacent to a top surface of a meter cover. The top surface of the meter cover may include a display that is visible on the outside of the meter cover. A metrology board, located inside the utility meter, is configured to connect with the communication device. The configuration disclosed herein makes it more feasible to site the communication device adjacent to the inside surface of the cover to optimize the performance of the communication system of the utility meter.

The utility meter also includes an antenna having one or more leads to couple the antenna with the communication device. The antenna is positioned at, within, or near an exterior surface of the utility meter, and is positioned to minimize or eliminate radio frequency interference with components of the metrology board. The antenna is coupled to the communication device by means of leads that extend inside the meter. In some embodiments, the antenna is coupled to the communication device by attaching the antenna leads to or through a surface of the communication device. For example, the antenna leads may pass through a through-hole opening beginning on a first surface of the communication device and attach to a second surface of the communication device, opposite the first surface, using a conventional joining technique (e.g., soldering). The through-hole coupling is particularly useful to provide access and sufficient clearance for joining.

In some embodiments, the utility meter also includes an antenna housing attachable to the meter cover configured to at least partially cover the antenna. The antenna housing may cooperate with non-conductive coatings or other non-conductive surfaces of the antenna to protectively insulate portions of the antenna that are not enclosed by the meter cover and otherwise would be susceptible to unintentional contact or exposure.

In some embodiments, the antenna housing forms a molding that can be secured around the antenna in the process of mounting the antenna to the communication device. In these embodiments, the antenna includes one or more hooks configured to be received by or otherwise fastened to at least a portion of the antenna housing, such that the hooks engage the antenna housing as the antenna is installed.

In some embodiments, the meter cover comprises a receiving channel that is sized and shaped to receive the antenna during coupling with the communication device. In other embodiments, the meter cover comprises a recessed channel and the antenna is configured to conform to a shape formed by the recessed channel. In some embodiments, the meter cover also includes one or more retention posts located within or near the recessed channel for positioning the antenna within the recessed channel.

In some embodiments, the utility meter utilizes one or more grommets configured to create a secure and sealed conduit. The grommets are in contact with a surface of and/or channel through the meter cover, receive the antenna leads, and provide a seal at a point of passage of the antenna leads through the meter cover for connection to the communication device. In some embodiments, the grommets allow insertion of the antenna leads at one or more angles.

The present technology additionally discloses a utility distribution system with at least one utility meter having a communication device coupled to an antenna, as described above, to minimize or eliminate radio frequency interference with the metrology board. Communications within the utility distribution system are accomplished in part via a first communication link useful for transmitting data to the utility meter. The first communication link may be used to transmit data from a supply grid or from a utility company to the utility meter. The distribution system also includes a second communication link for transmitting data from the utility meter, either to the grid or to the utility company.

The present technology additionally discloses a method for providing connection to a network with a utility meter at least in part by positioning the communication device described above adjacent the surface of a meter cover having the display. Additionally, the method comprises securing the antenna leads to the communication device. The antenna is positioned to minimize or eliminate radio frequency interference with the components of the metrology board and provide connection with the network.

Other aspects of the present invention will be in part apparent and in part pointed out hereinafter.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

Figure 1:
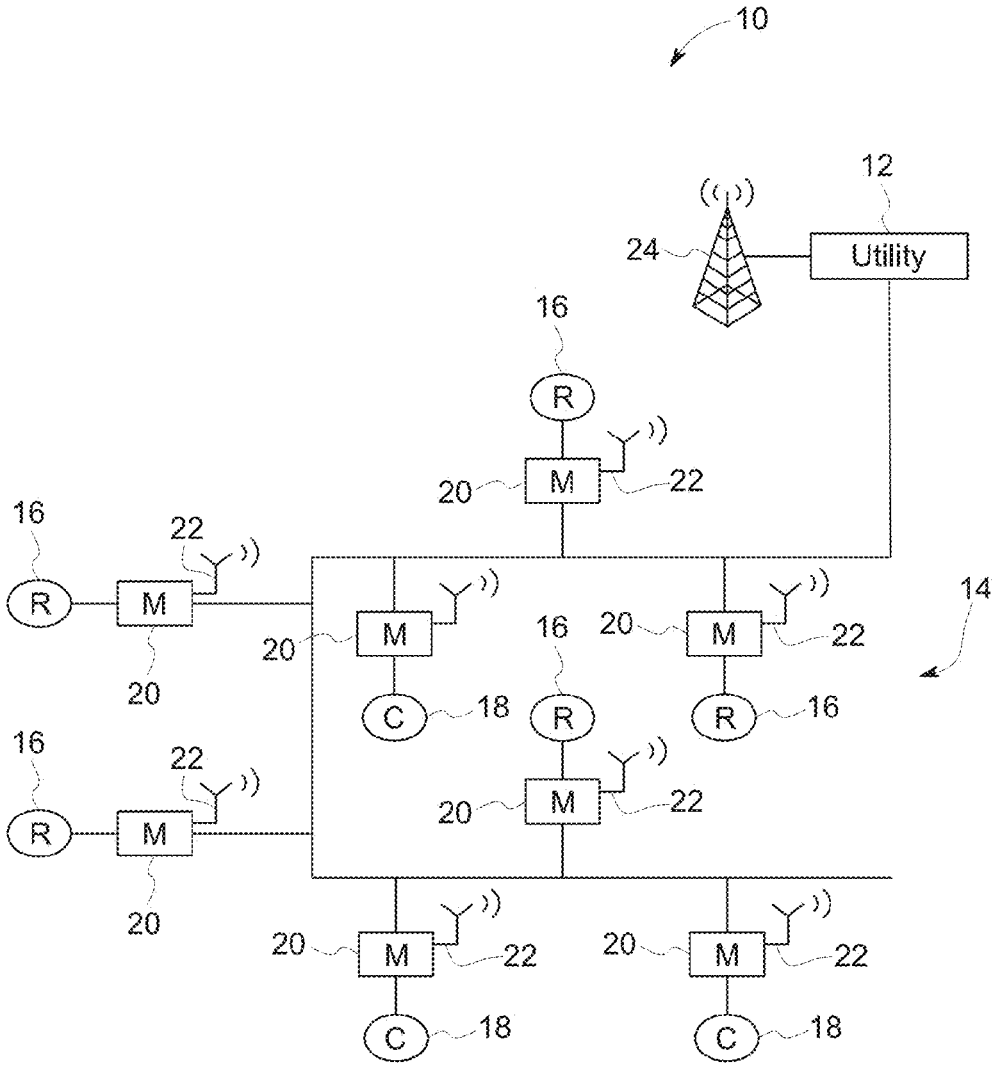
FIG. 1 is a block diagram of an embodiment of a utility distribution system in which utility meters monitor utility consumption by various consumers.

FIG. 1 is a block diagram that represents a utility system 10, which includes a utility 12 connected to a supply grid 14, which may include a distribution grid or a transmission grid. The utility may distribute electricity, water, or gas to consumers, such as residential establishments 16 and commercial establishments 18. For purposes of teaching, and not of limitation, the exemplary embodiments may be described in terms of supply of electrical power. In some embodiments, therefore, the utility system 10 is an electrical system, and the utility 12 is an electric utility that supplies power to a supply grid 14. In the electrical system, the residential 16 and commercial 18 establishments may include or constitute loads that are served by the supply grid 14. Utility meters 20 on the supply grid 14 may monitor the consumption or other utilization of the utility by the residential establishments 16 or commercial establishments 18.

In a normal operational state, the utility meters 20 may monitor consumption by the residential establishment 16 or the commercial establishment 18 to which they are affixed. Additionally, the utility meters 20 may communicate with the utility 12 via data communication links 22. Such data communication links 22 may be wired (e.g., over wired telecommunication infrastructure or supply grid 14) or wireless (e.g., a cellular network or other wireless broadband, such as WiMax).

Similarly, the utility 12 may employ a communication link 24 to communicate with the various utility meters 20. The communication link 24 may be wired or wireless, as may be suitable to communicate to the various communication links 22 of the utility meters 20.

The utility meters 20 may take a variety of forms. It should be noted that while the disclosed embodiments discussed below are in the context of an electric meter, other types of utilities are also presently contemplated. For example, meters in accordance with the disclosed embodiments may monitor and/or control any one or a combination of electricity, heat, gas, water, or any other utility, and may additionally or alternatively monitor anything that can be metered.

Figure 2:
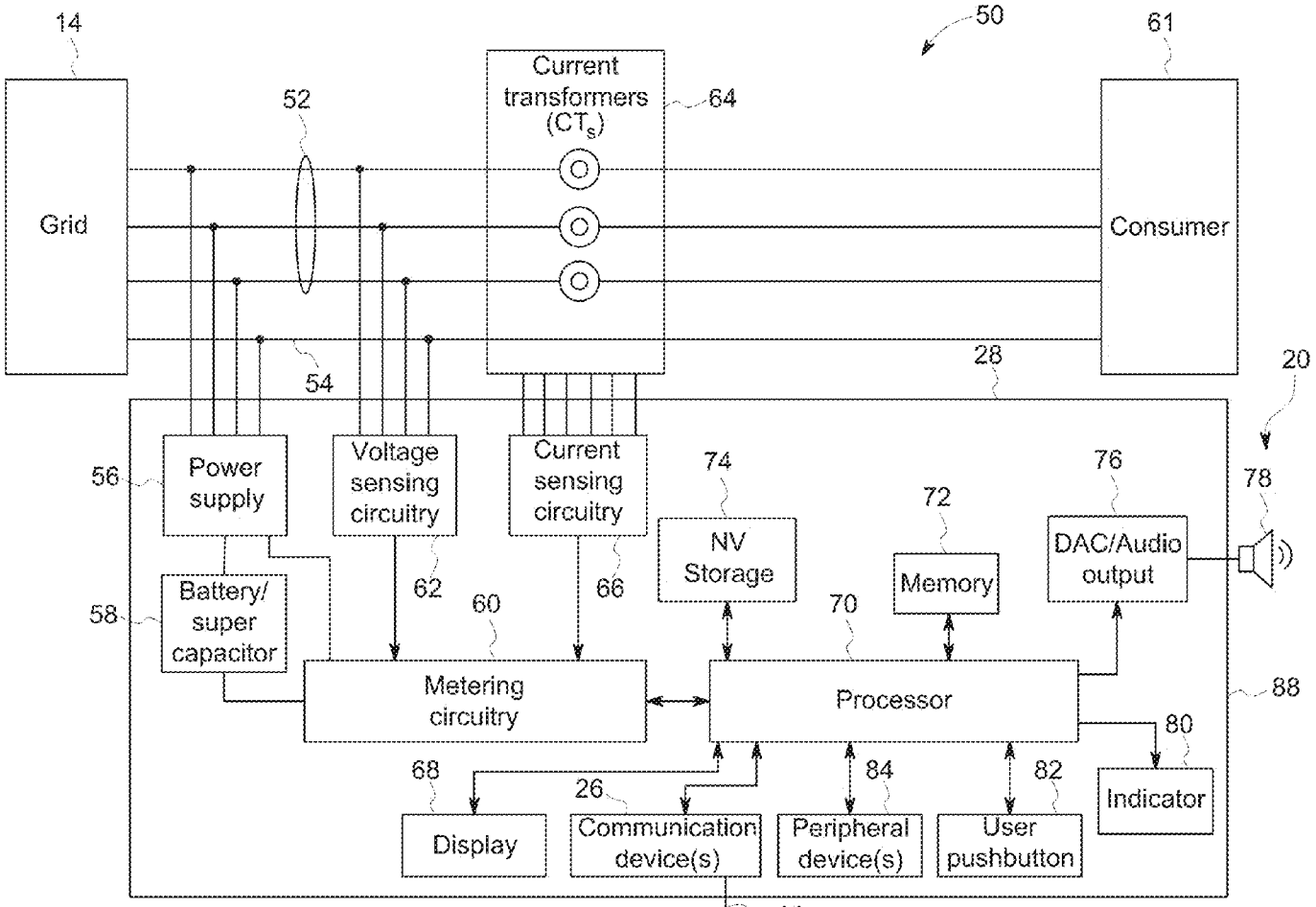
FIG. 2 is a block diagram of an exemplary utility meter that may be used in the utility distribution system of FIG. 1, in accordance with an embodiment.

FIG. 2 is a functional schematic showing certain components of a utility meter 20 in a power meter system 50. Joined to the power supply grid 14, the utility meter 20 monitors power flowing through power lines 52 and 54 of the supply grid 14 to an AC load (e.g., a residential, commercial, or industrial asset owned by a consumer). In the illustrated embodiment, the power lines 52 and 54 of the supply grid 14 may transmit three-phase power via three phase lines 52 and a neutral line 54. Although the embodiment of FIG. 2 involves monitoring three-phase power, alternative embodiments of the utility meter 20 may monitor single-phase power.

The utility meter 20 may include a metrology board 28 designed to operatively interconnect and position components of the utility meter 20 such as, but not limited to, one or more power supplies, processors, storage devices (e.g., memory), and network communication devices.

In the illustrated embodiment, the utility meter 20 may obtain power via a power supply 56 that couples to the three phase lines 52 and the neutral line 54 for its internal power consumption. To back up power consumption data in the event of a power outage, the power supply 56 may also charge a battery and/or super capacitor 58. In alternative embodiments, backup power may be fed by a non-rechargeable battery.

Metering circuitry 60 may ascertain power consumption by monitoring the voltage and current traversing the power lines 52 and 54 to the AC load (e.g., the consumer 61, residential establishment 16, and commercial establishment 18). In particular, voltage sensing circuitry 62 may determine the voltage based on the three phase lines 52 and the neutral line 54. Current transformers (CTs) 64 and current sensing circuitry 66 may determine the current flowing through the three phase lines 52.

The metering circuitry 60 may output the current power consumption values to an electronic display 68, such as a liquid crystal display (LCD), by way of a processor 70. The metering circuitry 60 may detect voltage and current inputs and send corresponding pulses to the processor 70, which calculates various data relating to the current power consumption of the consumer 61. For example, the processor 70 may calculate the energy accumulation, power factor, active power, reactive power and maximum demand, etc.

The processor 70 may store the demand details in memory 72 and/or nonvolatile storage 74, which may be NVRAM (EEPROM) or other suitable nonvolatile storage. In certain embodiments, multiple functions of the utility meter 20 may be implemented in a single chip solution, in which a single chip performs both the voltage/current sensing and the calculation of demand parameters. Certain audio alerts may be provided by the processor 70 to audio output circuitry 76 and/or 78, which may include a digital-to-analog converter (DAC) and a built-in speaker or external powered speakers connected by the consumer 61. These audio alerts may include, for example, an indication that the utility provider 14 has sent a demand response event request such as a renewable power notification.

The processor 70 may include one or more microprocessors, such as one or more "general-purpose" microprocessors, one or more application-specific processors (ASICs), or a combination of such processing components, which may control the general operation of the utility meter 20. For example, the processor 70 may include one or more instruction set processors (e.g., RISC), audio processors, and/or other related chipsets. The memory 72 and the nonvolatile storage 74 may provide instructions to enable the processor 70 to control the utility meter 20 and process the renewable power notification, for example.

The processor 70 may be operably coupled to the memory 72 and/or the storage 74 to carry out the presently disclosed techniques. These techniques may be carried out by the processor 70 and/or other data processing circuitry based on certain instructions executable by the processor 70. Such instructions may be stored using any suitable article of manufacture, which may include one or more tangible, computer-readable media to least collectively store these instructions. The article of manufacture may include, for example, the memory 72 and/or the nonvolatile storage 74. The memory 72 and the nonvolatile storage 74 may include any suitable articles of manufacturer for storing data and executable instructions, such as random-access memory, read-only memory, rewriteable flash memory, hard drives, and/or optical discs.

To interface with the consumer 61, the processor 70 may cause an indicator 80 to provide a signal or output such as, but not limited to, a light that intermittently illuminates or stays illuminated to indicate a predetermined instruction or a transcribes a message on the display 68. By way of example, such a message may include a demand response event request such as the renewable power notification. The consumer 61 may respond by pressing a user pushbutton 82 or via a peripheral device 84, such as a computing device (e.g., computer or portable phone) or an input device (e.g., a keyboard or touch-sensitive screen). These components of the utility meter 20, including the display 68 and the audio output circuitry 76 and/or 78, generally may represent the interface circuitry of the utility meter 20.

The utility meter also includes a communication device 26 such as a network interface controller (NIC) to communicate data provided by the utility meter 20 to the communication links 22, 24 or other network. As mentioned above, in some embodiments, a utility meter 20 by way of the communication device 26 may interface with the supply grid 14 and/or the utility 12.

The communication device 26 may be integrated into the utility meter 20 (e.g., built into the metrology board 28) or may be interconnected by being plugged into a bus (not illustrated) provided by the utility meter 20. In an embodiment illustrated in FIG. 3, the communication device 26 is integrated into the metrology board 28 by way of a connection 30. The connection 30 allows the communication device 26 to be powered from and/or in communication with the metrology board 28.

In some conventional utility meters, communication devices are positioned such that they do not come in contact with a casing or cover that encloses the utility meter. For example, the communication device may be connected to the metrology board in a location that is opposite a top surface of the cover which contains the display.

Figure 3:
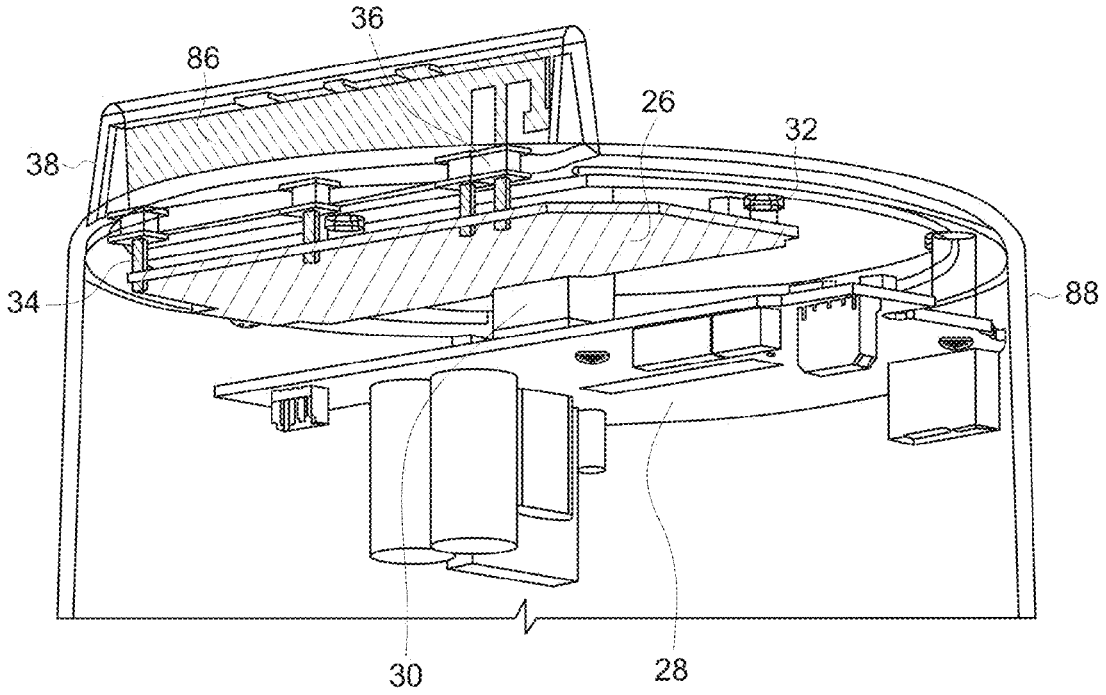
FIG. 3 is a bottom perspective view of a utility meter, according to an exemplary embodiment of the technology.
Figure 4:
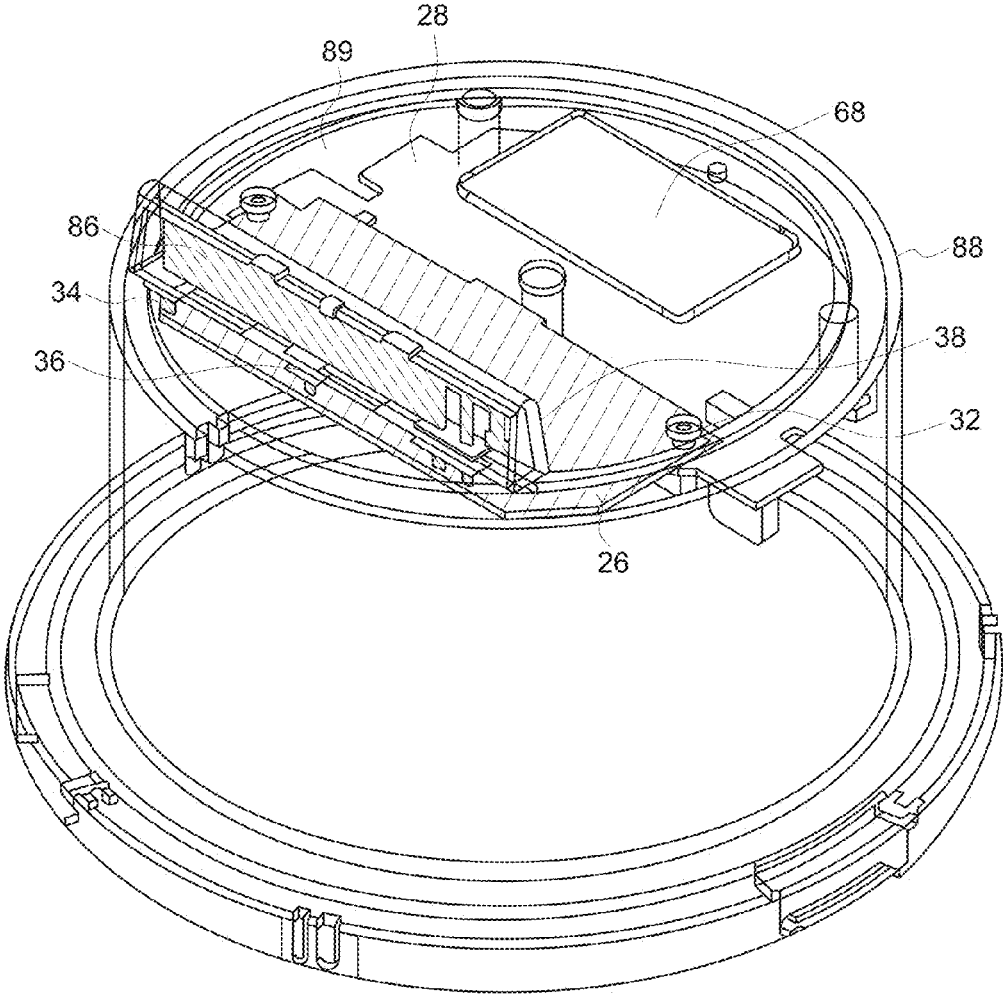
FIG. 4 is a top perspective view of the utility meter of FIG. 3.

In contrast, FIG. 3 illustrates the present technology where the communication device 26 is attached to the metrology board 28 in a location that is adjacent a meter cover 88 that contains the display 68. The communication device 26 may be attached to a top surface 89 of the cover 88 using one or more fasteners 32 such as, but not limited to rivets or snap-and-lock mechanisms (e.g., pins and clamps) that securely join the communication device 26 and the cover 88. The snap-and-lock mechanisms may be molded integrally with the cover 88. Such a configuration would reduce labor at assembly and improve the quality of the finished product.

The communication device 26 may, for example, include a card specifically designed for an assigned transmission technology such as, is not limited to, interfaces for a personal area network (PAN) such as a Bluetooth network, a local area network (LAN) such as an 802.11x Wi-Fi network, a wide area network (WAN) such as a 3G or 4G cellular network (e.g., WiMax), an infrared (IR) communication link, a Universal Serial Bus (USB) port, and/or a power line data transmission network such as Power Line Communication (PLC) or Power Line Carrier Communication (PLCC). The utility meter 20 may also control certain loads of the consumer 61 based on received instructions. Controlling these loads may involve communicating with the loads using a LAN (e.g., Wi-Fi) and/or a home power line network (e.g., X10).

The communication device 26 is coupled to at least one antenna 86. The antenna 86 is utilized to transmit information recorded by the processor 70, stored in the memory 72 and/or the storage 74 record information about electricity usage and transmit (e.g., automatically or on demand) the recorded data to the utility provider at regular intervals of time (e.g., every few seconds or minutes).

The antenna 86 may be any antenna suitable for transmission of data from the utility meter 20 to the communication links 22, 24, such as but not limited to inverted-F antennas.

The antenna 86 may contain one or more leads 34 that couple the antenna to the communication device 26. Substantially rigid leads are depicted, but alternately or additionally, the antenna 86 may be coupled to the communication device 26 using one or more cables as leads.

The antenna 86 is positioned to minimize or eliminate RF interference with the components of the metrology board 28. Interference, due to electromagnetic induction produced by the antenna 86, may interrupt, obstruct, or otherwise degrade performance components of the metrology board 28, such as metering circuitry 60. Altered performance of circuity within the metrology board 28 can range from a simple degradation of data to a total loss of data. Altered performance of circuity within the metrology board 28 may also stall or prevent data transmission to the utility 12 over the data communication link 22 for example.

In each of the embodiments described below, the antenna 86 is at least primarily positioned outside the cover 88 of the meter 20. For example, the antenna 86 may be disposed outside of a wall of the meter 20, rather than within an internal volume inside of the wall of the meter 20.

In some embodiments, the antenna 86 is at least partially covered by an antenna housing 38. The antenna housing 38 may be configured to protect material of the antenna 86 from elements (e.g., sun, dirt, and precipitation). The antenna housing may include the same material used for the cover 88. The antenna housing 38 may be made separate from the cover 88 or molded as an integral part of the cover 88.

The antenna housing 38 may include materials such as, but not limited to, electrically-insulating materials (e.g., polymers and rubber), flexible insulating materials (e.g., polyvinyl chloride (PVC)), and mineral based materials (e.g., steatite). In some embodiments, the antenna housing 38 may be substantially transparent, and may be formed from a plastic material.

Embodiments of the antenna 86 of the communication device 26 may include, but are not limited to the embodiments illustrated and discussed below.

The antenna 86 may be manufactured separate from the utility meter 20 and installed at a later time. To facilitate assembly and to protect the antenna 86, the cover 88 may be formed with a receiving channel (not illustrated) or other structure for receiving the antenna 86. The receiving channel is sized and shaped to receive the antenna 86.

The receiving channel is configured to prevent penetration of elements such as moisture and dirt from penetrating the cover 88, thus protecting the metrology board 28 and other components housed by the cover 88.

During attachment, manually or otherwise, to the utility meter 20, the antenna 86 is positioned to be in connection with and/or receive information from the communication device 26. For example, the antenna 86 may be attached to the communication device 26 by pushing antenna leads 34 (illustrated in FIG. 3) through seal grommets 36.

In some embodiments, the receiving channel may also be sized and shaped to receive the antenna housing 38, once the antenna 86 has been or as the antenna 86 is being coupled with communication device 26. The antenna housing 38 may be installed within the receiving channel to substantially enclose the antenna 86 and isolate the antenna 86 from an undesired contact, which may result in making an undesired electrical connection. In some embodiments, the antenna housing 38 is a separate component that is configured to attach to the receiving channel of the cover 88.

The seal grommets 36 provide a weather resistant seal that prevents moisture or debris from entering the cover 88. In some embodiments, the seal grommets 36 may include openings having a diaphragm feature within at least one grommet hole to enable receiving of the antenna leads 34. After attachment, the antenna 86 has an attached position that couples with the communication device 26. The insertion of the seal grommets 36 is further described in association with FIGS. 5 and 6.

Figure 5:
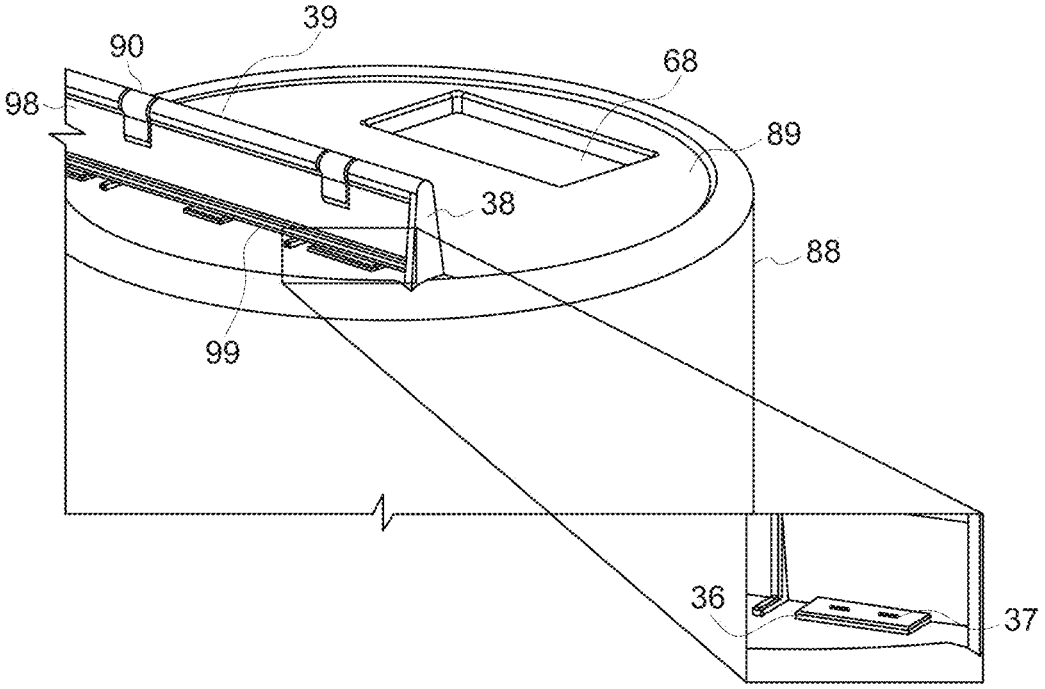
FIG. 5 is a side perspective view of the utility meter according to another exemplary embodiment, the view emphasizing details of a seal grommet via a callout.

In some embodiments, the antenna 86 is at least partially enclosed in a molding 98 and mechanically attached to the antenna housing 38, as illustrated in FIG. 5. In this embodiment, the antenna housing 38 protrudes (e.g., generally perpendicular) from the top surface 89 of the cover 88 containing the display 68.

The this embodiment, the antenna housing 38 forms a first eave 39 configured to divert elements, such as precipitation, from coming in contact with portions of the antenna 86 not enclosed by the molding 98. For example, the first eave 39 prevents rain from coming in contact with the antenna leads 34.

The molding 98 creates a protective barrier and diverter around the portion of the antenna 86 to attach to the antenna housing 38 while leaving at least the leads 34 exposed for inserting into the communication device 26, by way of the seal grommets 36, where present. Additionally, the molding 98 serves to prevent the antenna 86 from exposure to environmental conditions such as weather (e.g., sun and dirt) and contact from unintended objects external to the cover 88. For example, the molding 98 protects the antenna 86 from human contact to prevent electric shock or damage to the antenna.

In some embodiments, the molding 98 includes a second eave 99 where the molding 98 is configured to contact the cover 88. Similar to the first eave 39, the second eave 99 serves to prevent elements, such as precipitation, from contacting portions of the antenna 86 not enclosed by the molding 98.

To couple the antenna 86 with the communication device 26, the antenna leads 34 are inserted to the seal grommets 36, which in some embodiments contain one or more openings 37 for receiving the antenna leads 34. The openings 37, prior to insertion of the antenna leads 34, are illustrated in the callout of FIG. 5

Figure 6:
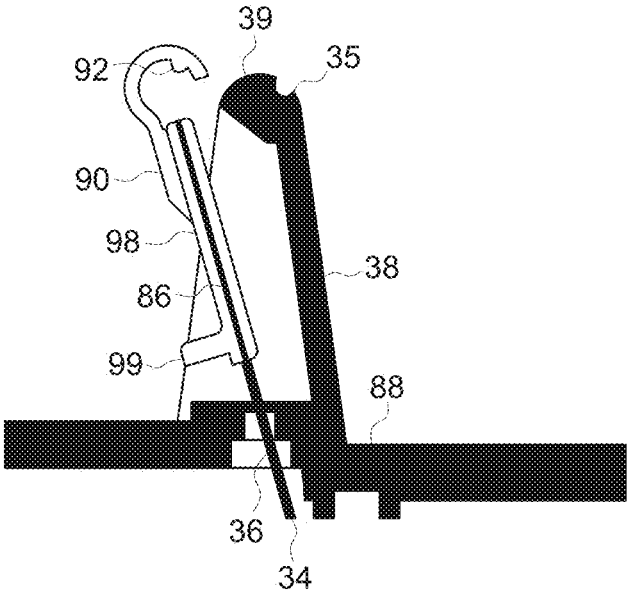
FIG. 6 illustrates a cross-sectional view of the antenna in FIG. 5, illustrating insertion of the antenna into the seal grommet.

FIG. 6 illustrates a cross-sectional view of the antenna housing 38, forming the first eave 39 and the antenna 86 enclosed in the molding 98, forming the second eave 99. The antenna leads 34 are exposed from the molding 98, and configured to insert through the cover 88, for contact with the communication device 26.

The antenna lead 34 may be inserted into the seal grommet 36 through the opening 37 at an angle. As such, it may be desirable for the seal grommet 36 to contain materials with flexible properties such as but not limited to rubber. The seal grommets 36 configured to contact the top surface 89 of and/or channel (not illustrated) through the cover 88. The seal grommets 36 are also configured to provide a seal at a point of passage of the antenna leads 34 through the cover 88 for connection to the communication device 26.

As the antenna lead 34 is inserted, the antenna 86 may attach to the antenna housing 38 by way of fastener, such as a hook 90. In fact, in the various embodiments, the antenna 86 may contain one or more hooks 90 configured to attach to the antenna housing 38. The hooks 90 are configured to contact and latch on to the antenna housing 38, which in some embodiments has one or more notches 35 for receiving the hooks 90.

The hooks 90 allows angled insertion of the antenna 86 enclosed in the molding 98 under the first eave 39. In such embodiments, the angle at which the antenna lead 34 is inserted into the opening 37 of the seal grommet 36 should be conducive for insertion and should also facilitate attachment to the molding 98/antenna 86 by causing each hook 90 to engage the antenna housing 38 as the antenna 86 is placed. Each hook 90 may include a protrusion 92, most clearly illustrated in the cross section of FIG. 6. The protrusion 92 on the hook 90 improves the clamp force and retention of the hook 90 as it engages the antenna housing 38.

Figure 7:
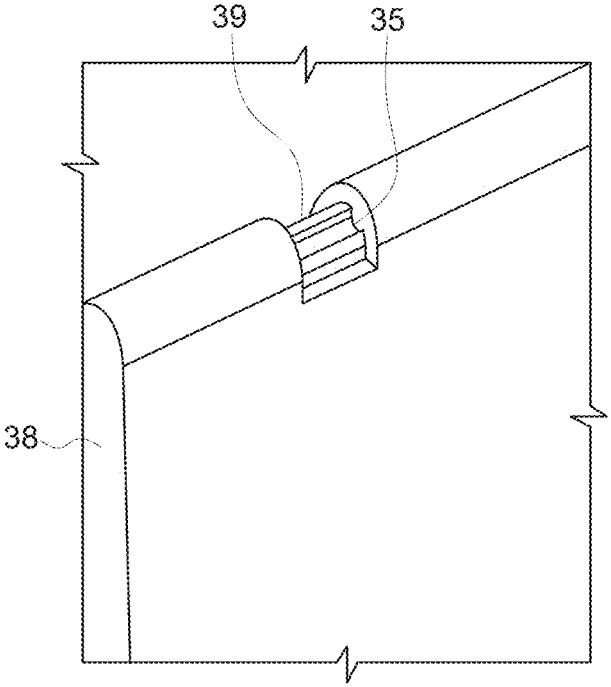
FIG. 7 is a perspective view the eave and notch of the antenna housing illustrated in FIG. 5.

In addition to forming the first eave 39, the antenna housing 38 may include a notch 35 formed along a distal edge of the first eave 39, as illustrated in FIG. 7. The notch 35 cooperates with the protrusion 92 on the hook 90 to create a clamp force that is useful to securely affix the molding 98/antenna 86 to the antenna housing 38. The notch 35 may be utilized where the hook 90 by itself will not create enough retention force to withstand environmental conditions such as high winds.

One skilled in the art will readily appreciate that the dimensions, shape, rigidity, material, and other configuration aspects of the hook 90 and the notch 35 are design choices that may vary in concert with other design choices, such as the profile, dimensions and materials chosen for the antenna housing 38, and fastness of the connection desired between the hook 90 and the antenna housing 38.

Figure 8:
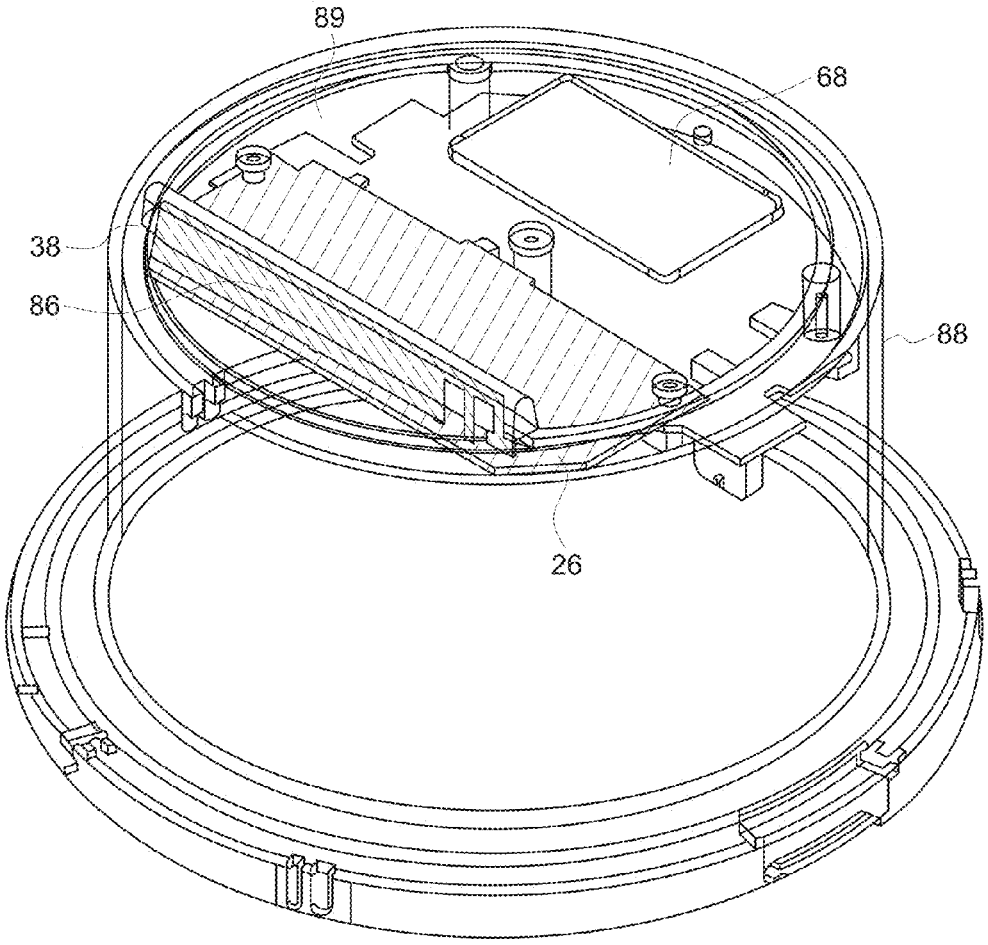
FIG. 8 is a top perspective view a utility meter according to another exemplary embodiment.

In some embodiments, as seen in FIG. 8, the antenna 86 is secured to the communication device 26 during manufacture. Coupling the antenna 86 and the communication device 26 during manufacture may allow the antenna 86 to be secured without the use of additional components (e.g., seal grommets 36), as the penetration can be sealed as part of the assembly process. Therefore, pre-coupling of the antenna 86 and the communication device 26 may be beneficial where a reduction in a height dimension of the meter cover 88 or a reduction in material consumption is desired.

During attachment, manually or otherwise, the antenna leads 34 are attached to the communication device 26. For example, the antenna leads 34 are may pass through a through-hole opening (not illustrated) beginning on a first surface of the communication device 26 and attach to a second surface of the communication device 26, opposite the first surface, using a conventional joining technique (e.g., soldering).

Where the antenna 86 is coupled the communication device 26 during manufacture, or is otherwise anticipated to be coupled to the communication device 26, the antenna housing 38 may be molded or otherwise formed as a portion of the cover 88 as illustrated in FIG. 5.

In addition, prior to or after coupling to the communication device 26, the antenna 86 itself may be inserted into an injection mold, and the meter cover 88 may be molded around (e.g., insert molded) the antenna 86. Such insertion-molding configurations are particularly useful in connection with antennas that consists primarily of a thin, metal-stamped part.

Insertion-molded antennas are sufficiently thin to be completely encapsulated and environmentally sealed with respect to an outside surface of the cover 88. However, the antenna leads 34 can be kept free from encapsulation such that the leads 34 extend inside of the cover 88, and such that cover 88 is formed from transparent material that will not obstruct RF signals. The transparent material can function as the antenna housing 38 as it serves as the cover 88.

As an example, an inverted-F antenna can be inserted into an injection mold, with the cover molded around the inverted-F antenna. In some such embodiments, the antenna 86 is molded into the top surface 89 of the cover 88. The antenna leads 34 extend inwardly with respect to the underside of the cover 88 and are left exposed, to be drawn through the first surface (e.g., topside) of communication device 26 and robotically soldered on the second surface (e.g., backside) of the communication device 26. In this fashion, the inverted-F antenna is essentially surrounded and encapsulated within the material of the meter cover, thereby achieving the objects described above.

Alternatives to insertion-molding include lamination, as the object of means for forming the antenna 86 within the top surface 89 of the meter cover is to achieve an integrated configuration. As another alternative, the antenna 86 may be disposed or pressed into a mold before material of the cover 88 has set, and material may optionally be deposited over the antenna 86, the material flowing over and setting as a continuous surface of the cover 88. As yet another alternative, the antenna 86 may be positioned within the cover 88 by three-dimensional printing, where printed material forms at least partially around the antenna 86 during formation of the cover 88.

In some embodiments, the cover 88 includes a protruding portion by which the antenna 86 has been affixed to the cover 88.

Figure 9:
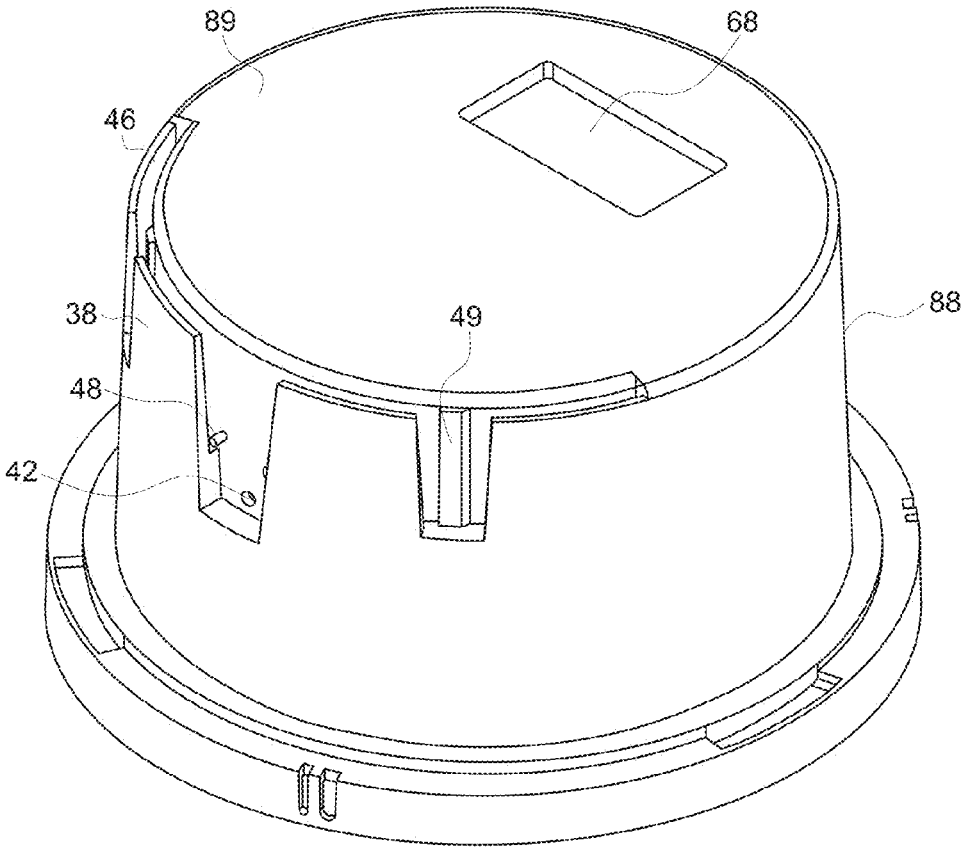
FIG. 9 is a top perspective view a utility meter cover according to a third exemplary embodiment.

In some embodiments, as illustrated in FIGS. 8 and 9, the cover 88 may be molded to receive a flexible antenna 86. Where the antenna 86 is flexible, the antenna 86 may be coupled to the communication device 26 utilizing a cable 40.

The flexible antenna 86 may be a flexible circuit that can conform to a desired shaped shape for a location. For example, the flexible circuit may conform the shape of a recessed channel 46 molded into the cover 88 using an injection mold slider, for example.

The recessed channel 46 is configured to receive the flexible antenna 86. In some embodiments, the recessed channel 46 may be molded directly into the cover 88. In these embodiments, the antenna housing 38 is molded into the cover 88. The antenna housing 38 at least partially covers the flexible antenna 86.

The recessed channel 46, as illustrated in FIG. 9 may have an opening, for receiving the flexible antenna 86, that includes a draft angle (illustrated as a tapered profile of the antenna housing 38) which is conductive for manufacturing the cover 88. Stated another way, the recessed channel 46 has a tapered profile that begins at the top surface 89 on which the display 68 is positioned that decreases in width through a channel depth.

Due to the draft angle, the flexible antenna 86 may not be secured within the recessed channel 46. Therefore, to prevent the flexible antenna 86 from moving within the recessed channel 46, one or more studs 49 may be used. The stud 49 serves as function similar to a shim. The studs 49 may be molded into the cover 88 as seen in FIG. 9, or inserted in the space between the flexible antenna 86 and the cover after insertion into the recessed channel 46.

Additionally, due to the flexible nature of the flexible antenna 86, one or more retention posts 48 are be molded into or otherwise affixed to the cover 88 in some embodiments.

Figure 10:
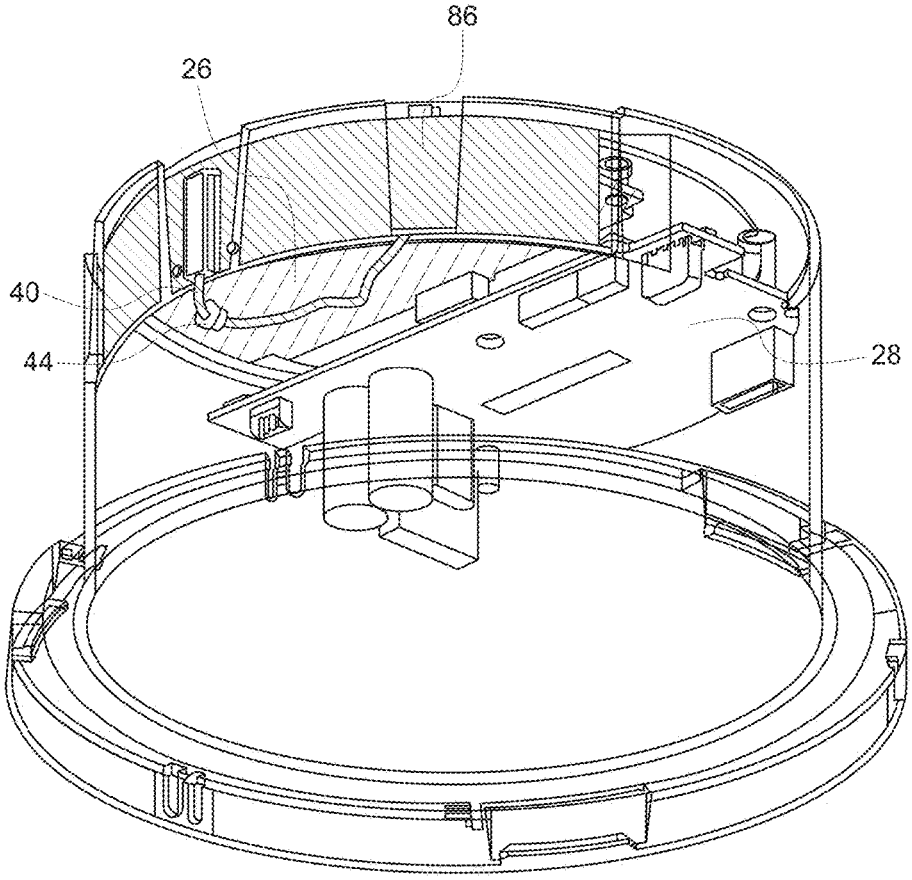
FIG. 10 is a bottom perspective view a utility meter cover of FIG. 9, including a flexible antenna.

FIG. 10 illustrates the flexible antenna 86 inserted positioned within the recessed channel 46 of the cover 88. As illustrated in FIG. 10, the cable passes through an opening 42, and in some embodiments, an eyelet grommet 44 is pressed into place in the opening 42, such that the cable 40 passes through the eyelet grommet 44 in the opening 42. The antenna 86 is attached to the cable 40 and positioned within the recessed channel 46.

The flexible antenna 86 is securely positioned within the recessed channel by the retention post 48, studs 49, or other similar features configured to secure the position and stabilize the flexible antenna 86.

The embodiments discussed above desirably position the antenna 86 away from radio frequency interference from components within the utility meter 20. The cover 88 may support the communication device 26, metering circuitry 60, and a name plate carrier. In some embodiments, the cover 88 may be integrated with the antenna 86, the communication device 26, metering circuitry 60, or a name plate carrier, or any combination thereof.

The invention claimed is:

1. A utility meter, comprising:

a cover comprising an end wall and an open end, wherein the end wall is opposite the open end and the end wall is vertical;

a communication device positioned adjacent to an inside surface of the end wall of the cover;

an antenna housing fixedly attached to an outside surface of the end wall of the cover, wherein the antenna housing extends horizontally across a lower half of the end wall of the cover and projects outwardly from an outer surface of the end wall of the cover; and an antenna received under the antenna housing such that the antenna housing covers an upper surface of the antenna, wherein the antenna is mounted externally with respect to the cover by the antenna housing, and wherein the antenna is coupled to the communication device through the end wall of the cover.

2. The utility meter of claim 1, wherein the antenna further comprises a hook configured to engage the antenna housing.

3. The utility meter of claim 2, wherein the hook is configured to engage the antenna housing to position the antenna in the antenna housing.

4. The utility meter of claim 2, wherein the hook and the antenna housing respectively include one of a protrusion and a notch, wherein the protrusion is configured to be received in the notch to facilitate the hook engaging the antenna housing.

5. The utility meter of claim 2, wherein the antenna is enclosed in a molding and the hook is attached to the molding.

6. The utility meter of claim 1, further comprising a grommet configured to receive an antenna lead and to seal a point of passage of the antenna lead through the cover for connection to the communication device.

7. The utility meter of claim 6, wherein the grommet is configured to allow for insertion of the antenna lead at one or more angles.

8. The utility meter of claim 6, wherein the antenna is configured to couple to the communication device by attaching the antenna lead to a surface on the communication device.

9. The utility meter of claim 1, wherein the antenna housing is electrically non-conductive.

10. The utility meter of claim 1, wherein a lead extends from the antenna through the cover and into an interior volume of the cover.

11. The utility meter of claim 1, wherein the antenna is perpendicular to the end wall.

12. The utility meter of claim 1, wherein the antenna housing includes a first eave covering the upper surface of the antenna.

13. The utility meter of claim 12, wherein the antenna is enclosed in a molding and the molding includes a second eave that is configured to at least partially close an opening in a bottom of the antenna housing.

14. The utility meter of claim 1, wherein the antenna is enclosed in a molding and the molding is configured to attach to the antenna housing.

15. The utility meter of claim 14, wherein the molding is configured to at least partially close an opening in the antenna housing.

16. The utility meter of claim 14, wherein the molding is configured to position the antenna in the antenna housing.

17. A utility meter cover, comprising:

an end wall and an open end, wherein the end wall is opposite the open end and the end wall is configured to be vertical when the utility meter cover is attached to a utility meter;

an antenna housing fixedly attached to an outside surface of the end wall, wherein the antenna housing extends horizontally across a lower half of the end wall and projects outwardly from an outer surface of the end wall; and wherein the antenna housing is configured to:

receive an antenna under the antenna housing such that the antenna housing covers an upper surface of the antenna; and mount the antenna externally with respect to the utility meter cover;

wherein the utility meter cover is configured to allow the antenna to be coupled to a communication device of a utility meter through the end wall; and wherein the utility meter cover is configured to cover the communication device such that the communication device is positioned adjacent to an inside surface of the end wall.

18. The utility meter cover of claim 17, further comprising a grommet configured to receive an antenna lead and to seal a point of passage of the antenna lead through the utility meter cover for connection to the communication device.

19. The utility meter cover of claim 18, wherein the grommet is configured to allow for insertion of the antenna lead at one or more angles.

20. The utility meter cover of claim 17, wherein the antenna housing is electrically non-conductive.

21. The utility meter cover of claim 17, wherein the antenna housing includes a first eave configured to cover the upper surface of the antenna.

* * * * *